United States Patent [19]

Panter et al.

[11] 4,402,812

[45] Sep. 6, 1983

[54] ELECTROLYTIC CELL

[75] Inventors: Herbert Panter, Hürth-Alstädten; Hermann Klein, Hürth; Gerhard Nolte; Eberhard Preisler, both of Erftstadt; Hans-Werner Stephan, Cologne; Günter Reichert, Bornheim-Merten, all of Fed. Rep. of Germany

[73] Assignee: Hoechst Aktiengesellschaft, Fed. Rep. of Germany

[21] Appl. No.: 359,502

[22] Filed: Mar. 18, 1982

[30] Foreign Application Priority Data

Mar. 25, 1981 [DE] Fed. Rep. of Germany ..... 3111628

[51] Int. Cl.[3] ..... C25C 3/04; C25C 3/16

[52] U.S. Cl. ..... 204/275; 204/245; 204/286; 204/288; 204/289

[58] Field of Search ..... 204/275, 288, 289, 243 R, 204/245, 278, 276, 277

[56] References Cited

U.S. PATENT DOCUMENTS

| | | | |
|---|---|---|---|
| 1,788,462 | 1/1931 | Johnstone | 204/277 |
| 3,402,117 | 9/1968 | Evans | 204/288 |
| 3,505,198 | 4/1970 | Harnisch et al. | 204/275 |
| 3,697,404 | 10/1972 | Paige | 204/288 |
| 4,276,147 | 6/1981 | Epner et al. | 204/275 |
| 4,319,970 | 3/1982 | Schatton et al. | 204/288 |

*Primary Examiner*—Howard S. Williams

*Assistant Examiner*—Terryence Chapman

*Attorney, Agent, or Firm*—Connolly and Hutz

[57] ABSTRACT

The disclosure provides an electrolytic cell sealed in gas-tight and liquid-tight fashion. The cell is comprised of a box-shaped cell tank open at its top and provided with at least one intake duct, at least one overflow duct and at least one discharge duct. A cover is placed on the cell tank and two opposed flanges receiving electrode supporting frames are secured to the inside of the cell tank near the upper end thereof. A chemically resistant and electrically insulating coating is applied to the inside of the cover and cell tank and a plurality of semi-circular recessed grooves spaced apart from each other are formed in the upper rim portion of at least one of the side walls of the cell tank, the recessed grooves receiving semi-circular current beams projecting outwardly. A first elastic packing structurally conformed to the upper rim portion of the cell tank including the recessed grooves is placed thereon and a second elastic packing arranged at the underside of the cover co-operates with the upper side of the current beam and the first elastic packing whereby the electrolytic cell becomes gas tightly sealed. A main current rail is arranged to run outside the cell tank laterally with respect thereto and so as to be spaced therefrom, the rail providing large contact areas supporting the projecting end of the current beams. The electrode supporting frames and the current beams are electrically conducting inside the electrolytic cell.

7 Claims, 5 Drawing Figures

ELECTROLYTIC CELL

Figure 1:
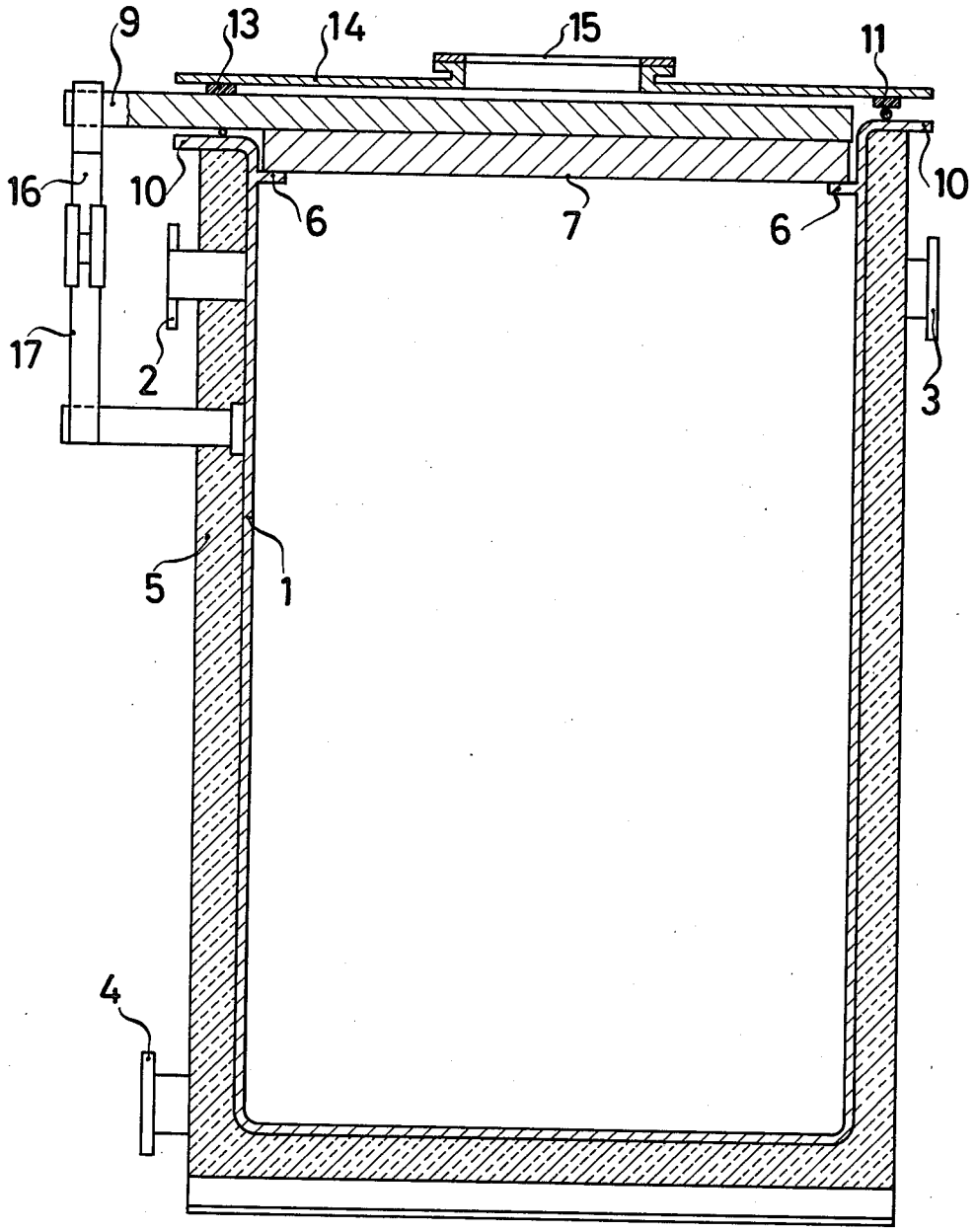

The present invention relates to an electrolytic cell sealed in gas-tight and liquid-tight fashion wherein a boxshaped cell tank open at its top is provided with at least one intake duct, at least one overflow duct and at least one discharge duct; wherein a cover having elastic packings secured to its underside is placed on the cell tank and two opposed flanges receiving electrode supporting frames are secured to the inside of the cell tank near the upper end thereof; the insides of the cover and cell tank having a chemically resistant and electrically insulating coating applied thereto.

US-PS No. 3,505,198 discloses an electrolytic cell sealed in gas-tight and liquid-tight fashion and being comprised of a box-shaped cell tank open at its top, a supporting frame mounted on the cell tank providing support for a cover. The cell tank is formed with an intake duct, overflow duct and discharge duct and the cover has ducts receiving current supply bolts, which are passed therethrough. Secured to the lower side of the supporting frame is a flange extending towards the inside to provide area supporting electrode-supporting beams. The cell tank, supporting frame and cover all have a chemically resistant and electrically insulating coating applied to their inside. Secured to each cathode frame and anode frame inside the cell tank is a current supply bolt extending vertically upwards, ducts provided in the cover for receiving the current supply bolts being gas tightly sealed by means of a rubber bellows. Above the cover each of the current supply bolts is bolt-connected to a copper strip as a current supply wire.

Whenever use is made of an electrolytic cell such as just described in an electrolysis, during which electrolytic product is deposited on an electrode, e.g. in the electrolytic production of manganese dioxide from a manganese salt solution, it is necessary, prior to each removal of final product from the electrolytic cell, first to dismantle a series of copper strips and rubber bellows to permit lifting off the cover, and thereafter to remount these structural elements for repositioning the cover.

The present invention now provides an electrolytic cell permitting its cover to be easily removed for discharging solid electrolytic product, and to be repositioned, and for the electrodes to be taken from the opened cell just by lifting them.

To this end, the invention provides for the electrolytic cell comprised of a box-shaped cell tank open at its top and having a cover placed thereon to also comprise: a plurality of semi-circular recessed grooves spaced apart from each other in the upper rim portion of at least one of the side walls of the cell tank, the recessed grooves receiving semi-circular current beams projecting outwardly; a first elastic seal structurally conformed to the upper rim portion of the cell tank including the recessed grooves being placed thereon, a second elastic seal arranged at the underside of the cover co-operating with the upper side of the current beam and the first elastic seal whereby the electrolytic cell becomes gastightly sealed; a main current rail running outside the cell tank laterally with respect thereto and being spaced therefrom, the rail providing large contact areas supporting the projecting ends of the current beams; and the electrode supporting frames and the current beams being electrically conducting inside the electrolytic cell.

Further preferred features of the invention provide (a) for the upper rim portion of the cell tank to be a flange having an encircling groove which partially receives the seal formed in its upper side;

(b) for the seal to be a round string seal;

(c) for the upper rim portion of the cell tank to have a semi-sectional seal formed with a recessed groove applied to it;

(d) for the laterally projecting ends of the current beams to be held in spring elastic forks mounted on the main current rail;

(e) for the forks to be made of copper; and (f) for the electrode supporting frames and current beams to be rigidly connected together.

In the electrolytic cell of this invention which is more especially used for making manganese dioxide by anodic oxidation of manganese salt solutions, electric power is admitted to the cathode and anodes laterally with respect thereto between the upper rim portion of the cell tank and cover, whereby the operations necessary to effect the change of electrodes to recover electrolytic product are rendered considerably easier. The reason for this resides in the fact that no use is made in the present electrolytic cell of (a) the sealing bellows which are screw-connected to the current supply bolts and (b) of flexible supply wires. In this context, it should be borne in mind that the current supply wires formed of braided copper strips having a large surface area are very difficult to move and incidentally are very liable to undergo strong corrosion, on account of their large surface areas.

By using one of the preferred forms of the electrolytic cell of this invention for electrolysis, it is possible to produce very intensive electric contact between the current beams and spring elastic forks so that it is unnecessary to provide for a bolt connection, e.g. via flexible copper strips.

Figure 2:
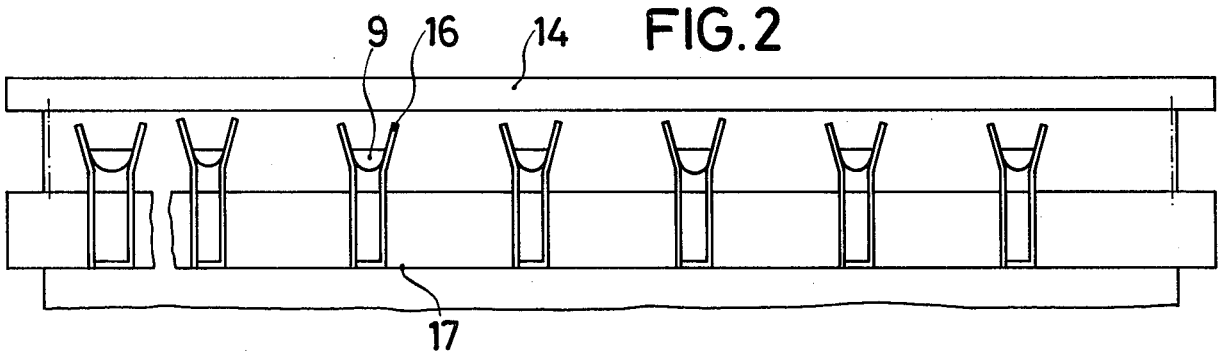
Figure 3:
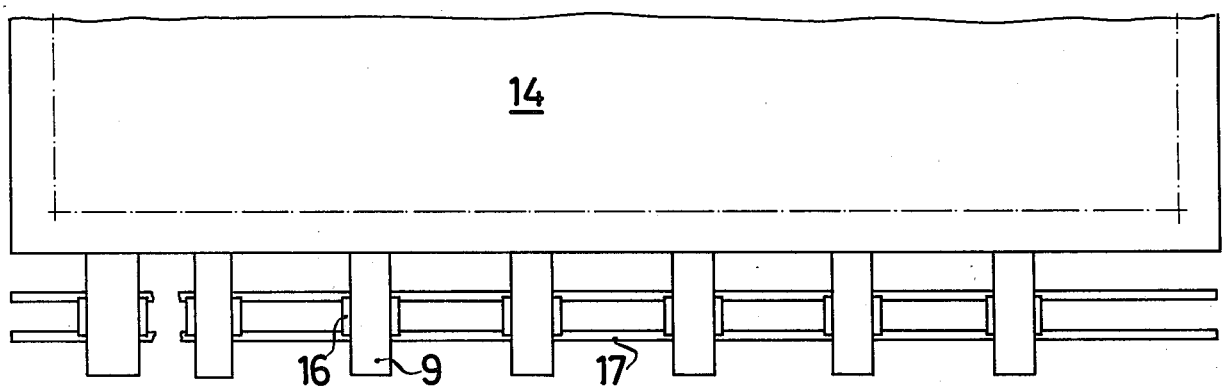
Figure 4:
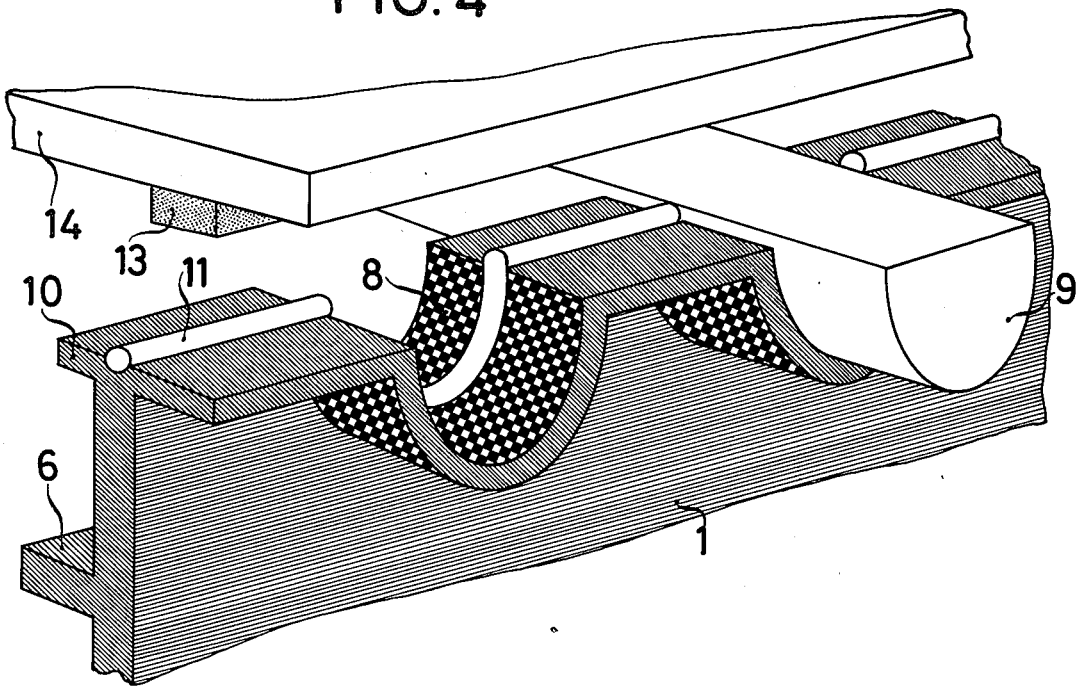
Figure 5:
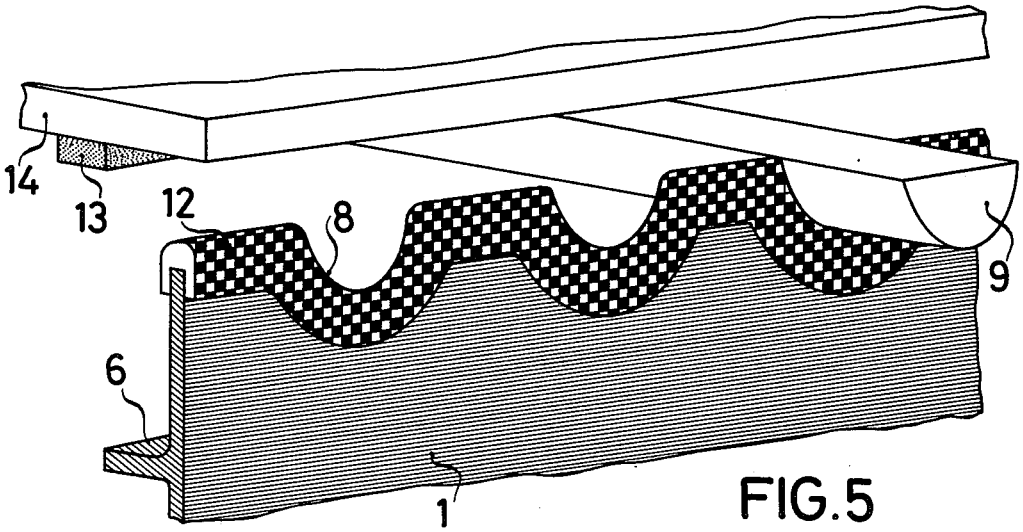

The invention will now be described and by way of example with reference to the accompanying drawings, of which FIG. 1 is a side elevational view of an electrolytic cell, FIG. 2 is a side elevational view of the upper end of the electrolytic cell, FIG. 3 is a top plan view of a portion of the electrolytic cell, and FIGS. 4 and 5 are steric representations of a portion of the upper end of the electrolytic cell.

As can be seen, a cell tank 1 open at its top has a rubber coating applied to its inside surfaces, is formed with an intake duct 2, an overflow duct 3 and a discharge duct 4, and has a heat-retaining layer 5 applied to one of its outsides. Disposed in the upper portion of cell tank 1 are two opposed flanges 6 receiving electrode supporting frames 7. The upper rim portion of cell tank 1 is formed at one of its sides with a plurality of semicircular recessed grooves 8 which have semicircular current beams 9 projecting outwardly positioned therein. The upper rim of the cell tank 1 may be formed with a flange 10 including recessed grooves 8, an encircling slot being in this event provided approximately in the center portion of flange 10 and also in the region of the recessed grooves 8, for receiving a round string packing 11. It is also possible for the upper rim portion of cell tank 1 to have an encircling slotted semisectional packing 12 applied to it. The current beams 9 and upper rim portion of cell tank 1, respectively, provide support for a cover 14 which has elastic packings 13 secured to its underside and is formed with just one opening receiving a bursting disk 15. The ends of current beams 9 projecting outwardly from cell tank 1 are held in spring elastic forks 16 which provide a large supporting surface area and are secured to the main current rail 17.

We claim:

1. An electrolytic cell sealed in gas-tight and liquid-tight fashion comprising a box-shaped cell tank open at its top and provided with at least one intake duct, at least one overflow duct and at least one discharge duct; a cover being placed on the cell tank; two opposed flanges receiving electrode supporting frames being secured to the inside of the cell tank near the upper end thereof; a chemically resistant and electrically insulating coating being applied to the inside of the cover and cell tank; a plurality of semi-circular recessed grooves spaced apart from each other being formed in the upper rim portion of at least one of the side walls of the cell tank, the recessed grooves receiving semi-circular current beams projecting outwardly; a first elastic packing structurally conformed to the upper rim portion of the cell tank including the recessed grooves being placed thereon; a second elastic packing arranged at the underside of the cover co-operating with the upper side of the current beam and the first elastic packing whereby the electrolytic cell becomes gas-tightly sealed; a main current rail running outside the cell tank laterally with respect thereto and being spaced therefrom, the rail providing large contact areas supporting the projecting ends of the current beams; and the electrode supporting frames and the current beams being electrically conducting inside the electrolytic cell.

2. The electrolytic cell as claimed in claim 1, wherein the upper rim portion of the cell tank is a flange having an encircling slot formed in its upper side the slot partially receiving said first elastic packing.

3. The electrolytic cell as claimed in claim 2, wherein said first elastic packing is a round string packing.

4. The electrolytic cell as claimed in claim 1, wherein said first elastic packing is formed by a semisectional packing having a recessed groove therein, said semisectional packing being applied to the upper rim portion of the cell tank.

5. The electrolytic cell as claimed in claim 1, wherein the laterally projecting ends of the current beams are held in spring elastic forks mounted on the main current rail.

6. The electrolytic cell as claimed in claim 5, wherein the forks are made of copper.

7. The electrolytic cell as claimed in claim 1, wherein the electrode supporting frames and current beams are rigidly connected together.

* * * * *